US006878104B2

(12) United States Patent
Trovinger et al.

(10) Patent No.: US 6,878,104 B2
(45) **Date of Patent: *Apr. 12, 2005**

(54) VARIABLE MEDIA THICKNESS FOLDING METHOD

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/971,351

(22) Filed: Oct. 5, 2001

(65) Prior Publication Data

US 2003/0069119 A1 Apr. 10, 2003

(51) Int. Cl.[7] ..... B31F 1/00

(52) U.S. Cl. ..... 493/445; 493/437; 493/444; 493/446

(58) Field of Search ..... 493/405, 416, 493/437, 444, 438, 445, 395, 446

(56) References Cited

U.S. PATENT DOCUMENTS

| | | | | |
|---|---|---|---|---|
| 411,151 | A | * 9/1889 | Kneeland | 493/445 |
| 1,937,453 | A | * 11/1933 | Wood | 493/442 |
| 2,514,737 | A | * 7/1950 | Anderson | 493/445 |
| 3,202,066 | A | 8/1965 | Palmer | |
| 3,398,661 | A | 8/1968 | Mathes et al. | |
| 3,434,399 | A | 3/1969 | Palmer | |
| 3,916,749 | A | 11/1975 | Armelin | |
| 3,926,425 | A | * 12/1975 | Pierce et al. | 493/444 |
| 3,978,773 | A | 9/1976 | Pinto | |
| 3,995,849 | A | 12/1976 | Kistner | |
| 4,015,838 | A | 4/1977 | Thurmann | |
| 4,041,849 | A | 8/1977 | Tsukasaki | |
| 4,053,150 | A | 10/1977 | Lane | |
| 4,101,121 | A | 7/1978 | Rastorguyeff | |
| 4,221,373 | A | 9/1980 | Muller | |
| 4,226,410 | A | 10/1980 | McIntosh, Sr. et al. | |
| 4,265,437 | A | 5/1981 | Reist et al. | |
| 4,310,326 | A | 1/1982 | Bellanca | |
| 4,419,088 | A | * 12/1983 | Nemec | 493/444 |
| 4,496,339 | A | 1/1985 | Moll | |
| 4,557,714 | A | 12/1985 | Sabelstrom et al. | |
| 4,571,237 | A | * 2/1986 | Vogtlander | 164/238 |
| 4,595,187 | A | 6/1986 | Bober | |
| 4,614,512 | A | 9/1986 | Capdeboscq | |
| 4,643,705 | A | 2/1987 | Bober | |
| 4,834,696 | A | 5/1989 | Marschke | |
| 4,891,681 | A | 1/1990 | Fiske et al. | |
| 4,893,803 | A | 1/1990 | Petersen | |
| 5,007,891 | A | * 4/1991 | von Hein | 493/444 |

(Continued)

FOREIGN PATENT DOCUMENTS

| | | |
|---|---|---|
| DE | 4018709 | 1/1991 |
| EP | 0038942 | 4/1981 |
| WO | WO 00/18583 | 4/2000 |

OTHER PUBLICATIONS

U.S. Appl. No. 09/970,730, filed Oct. 5, 2001, entitled "Sheet Folding Apparatus", Steven W. Trovinger et al.

U.S. Appl. No. 09/970,748, filed Oct. 5, 2001, entitled "Thick Media Folding Method", Steven W. Trovinger et al.

(Continued)

*Primary Examiner*—Eugene Kim
*Assistant Examiner*—Christopher Harmon

(57) ABSTRACT

A system for folding sheet material is provided, including a fold blade, two fold components biased toward one another, and first drive means for moving at least one of the fold blade and the two fold components to position the fold blade between the two fold components and thereby displace the two components away from one another, where the two fold components are mounted on different support elements.

14 Claims, 5 Drawing Sheets

U.S. PATENT DOCUMENTS 5,028,193 A 7/1991 Misicka
5,080,339 A 1/1992 Hirahara
5,087,163 A 2/1992 Erdbories et al.
5,092,827 A 3/1992 McAdam, III et al.
5,114,392 A 5/1992 McAdam, III et al.
5,147,276 A 9/1992 Stab
5,169,376 A * 12/1992 Ries et al. ..... 493/445
5,190,514 A 3/1993 Galvanauskas
5,230,686 A 7/1993 McAdam, III et al.
5,242,364 A 9/1993 Lehmann
5,346,350 A 9/1994 Luhman et al.
5,377,965 A 1/1995 Mandel et al.
5,452,920 A 9/1995 Parker
5,465,213 A 11/1995 Ross
5,738,620 A 4/1998 Ebner et al.
5,803,891 A 9/1998 Haan et al.
5,937,757 A 8/1999 Jackson et al.
5,979,348 A 11/1999 Yaguchi
5,997,459 A 12/1999 Kruger et al.
6,074,332 A * 6/2000 Helmstadter et al. ..... 493/254
6,090,032 A 7/2000 Bellanca
6,094,225 A 7/2000 Han
6,120,427 A 9/2000 Haan et al.
6,193,458 B1 2/2001 Marsh
6,363,851 B1 4/2002 Gerhard et al.
6,673,002 B1 * 1/2004 Trovinger et al. ..... 493/405

OTHER PUBLICATIONS

U.S. Appl. No. 09/970,840, filed Oct. 5, 2001, entitled "Sheet Folding Apparatus with Rounded Fold Blade", Steven W. Trovinger et al.
U.S. Appl. No. 09/970,877, filed Oct. 5, 2001, entitled "Sheet Folding Apparatus with Pivot Arm Fold Rollers", Steven W. Trovinger et al.
U.S. Appl. No. 10/259,458, filed Sep. 30, 2002, entitled "Method and Apparatus for Sheet Folding", Steven W. Trovinger.

* cited by examiner

VARIABLE MEDIA THICKNESS FOLDING METHOD

BACKGROUND OF THE INVENTION

1. Field of the Invention

The present invention relates generally to processing sheet material and, more particularly, to a sheet folding apparatus using fold rollers that are biased toward one another.

2. Background Information

Several systems for folding material are known in the art where the characteristics of particular folding components are adjustable. For instance, some systems allow for the manual adjusting of distances between folding rollers, as described in U.S. Pat. No. 5,190,514 (Galvanauskas), U.S. Pat. No. 5,242,364 (Lehmann), and U.S. Pat. No. 5,937,757 (Jackson et al.), the disclosures of which are hereby incorporated by reference in their entirety. In these systems, an operator must have knowledge of a material's properties (such as weight or thickness) before carefully adjusting the system to accommodate those properties.

Other folding systems include self-adjusting components, such as the system described in U.S. Pat. No. 5,738,620 (Ebner et al.), the disclosure of which is hereby incorporated in its entirety. In the Ebner patent, a stack of sheets is pushed between a pair of pre-folding rollers and a pair of folding rollers by a folding knife. One half of each roller pair is spring-loaded towards the other half and pivots away from the other half when a stack of sheets is introduced by the folding knife. While such a system allows for some automatic adjustment, much force is needed to force a stack of sheets between the rollers. Also, due to the orientation of the Ebner system, a stack of sheets can not be folded more than one time.

A system for finishing printed sheets into booklets is described in PCT Document No. WO 00/18583 (Trovinger et al.). The Trovinger PCT includes an operation where individual booklet sheets are folded using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to in effect crease the sheet. The number and spacing of these rollers are such that during horizontal movement of the fold rollers, at least one fold roller passes over every point along the portion of a sheet where a fold is to be formed.

The Trovinger PCT also describes the use of self-adjusting, v-shaped fold rollers, each of which include two complementary disks that are spring-loaded on a common axle. However, rollers of this shape and configuration may only be useful for folding a limited range of materials.

It would be desirable to provide for precise folding of a wide range of sheet materials where fold rollers are self-adjustable.

SUMMARY OF THE INVENTION

Accordingly, the present invention is directed to an apparatus that folds sheet material by displacing fold rollers along a fold blade, where the fold blade is positioned between the fold rollers and where the fold rollers are biased towards one another. In this way, a wide range of sheet materials can be precisely folded.

According to one embodiment of the present invention, a system for folding sheet material is provided, including a fold blade, two fold components biased toward one another, and first drive means for moving at least one of the fold blade and the two fold components to position the fold blade between the two fold components and thereby displace the two components away from one another, where the two fold components are mounted on different support elements.

According to another embodiment of the present invention, a method for folding a sheet of material is provided, including the steps of feeding a sheet material into an area between two fold components and a fold blade, where the two fold components are biased toward one another and are mounted on different support elements, and moving the two fold components and the fold blade relative to one another to form a fold in the sheet using the fold blade, thereby displacing the two components away from one another.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1A:
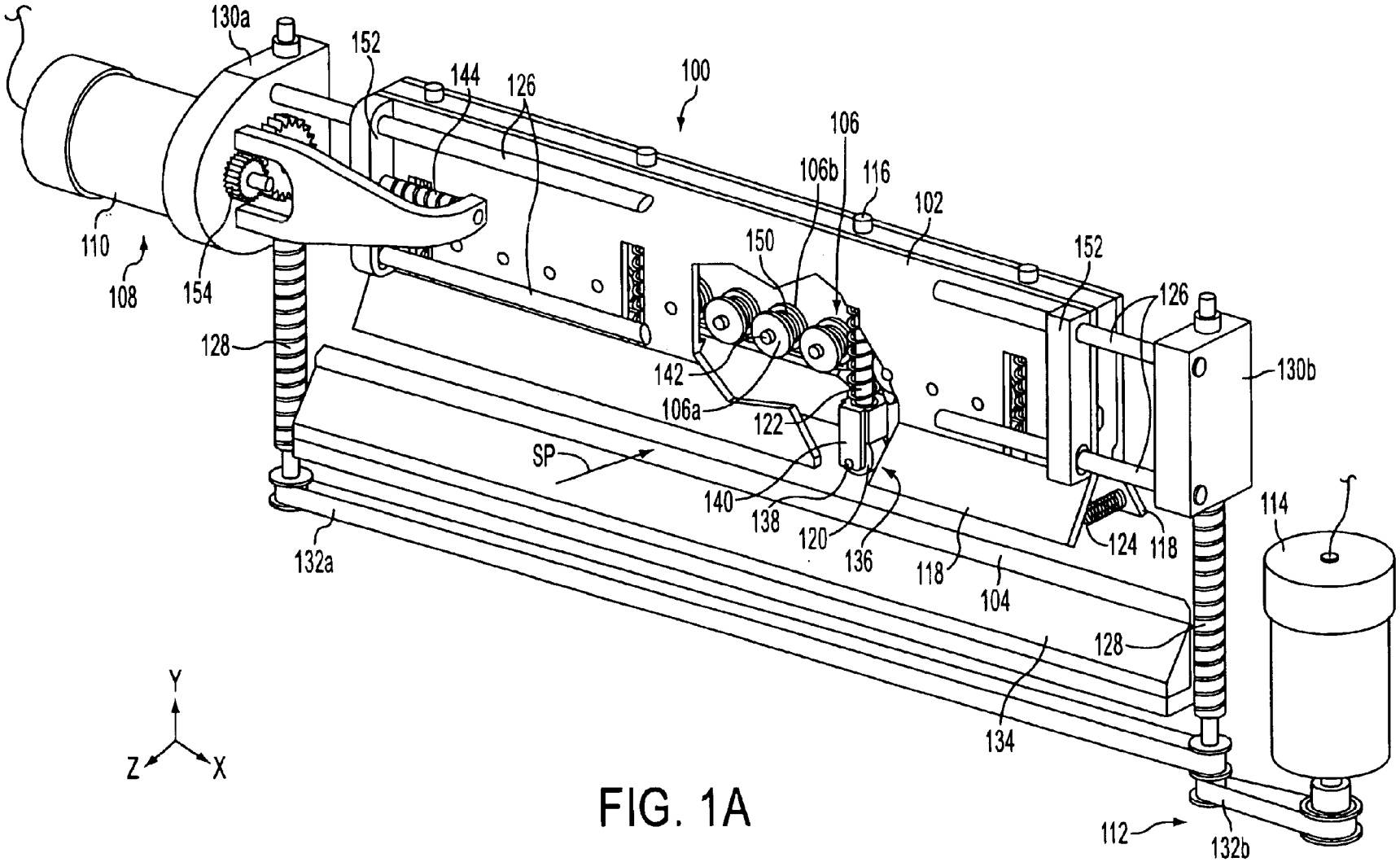
FIGS. 1A and 1B illustrate perspective views of a folding apparatus in accordance with an exemplary embodiment of the present invention.
Figure 1B:
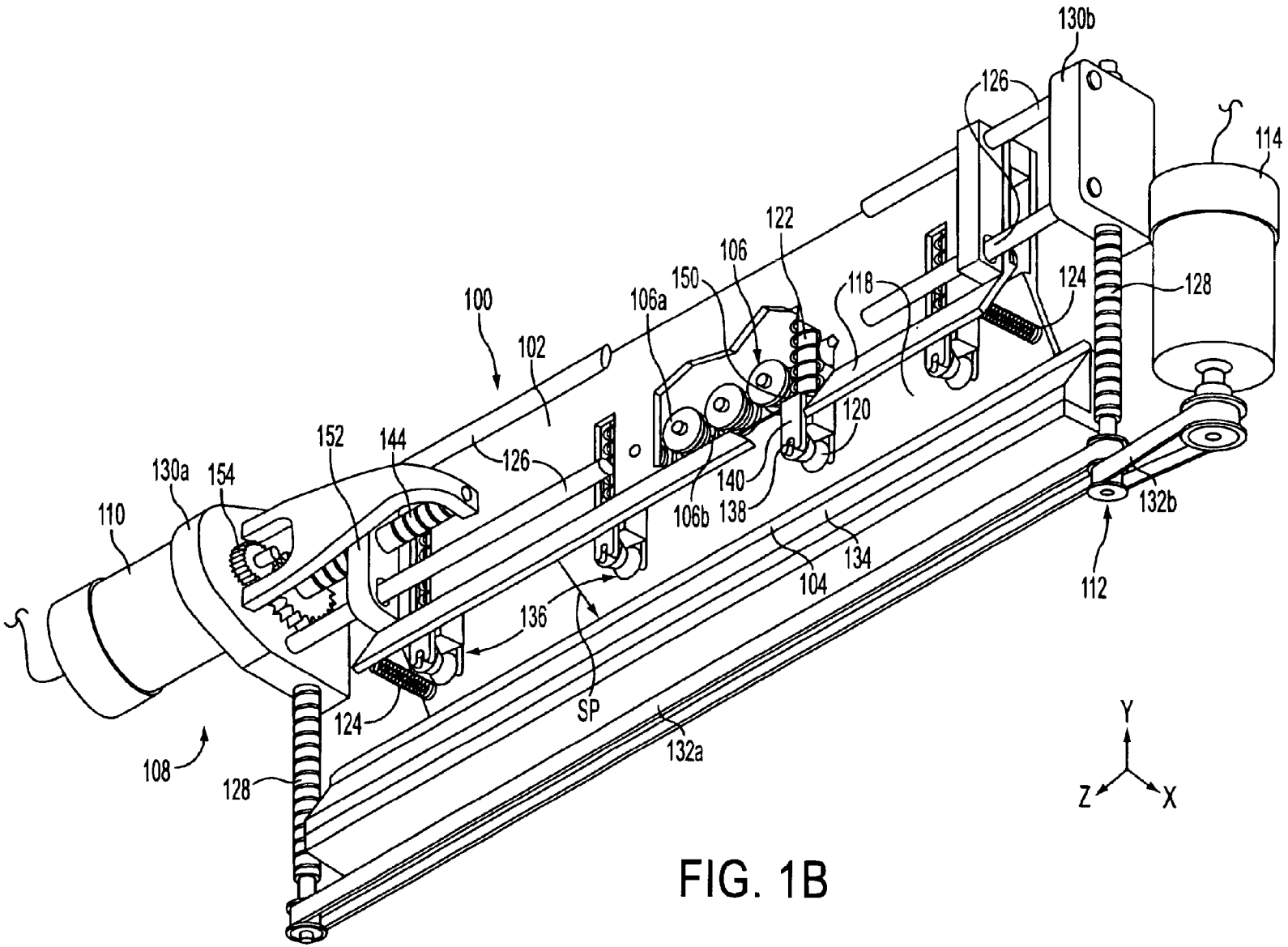

A system for folding sheet material is represented as folding apparatus 100 in FIGS. 1A and 1B. The exemplary folding apparatus 100 includes a fold blade, such as fold blade 104 having a longitudinal axis along the x-axis of FIG. 1A. Fold blade 104 is shown to be held by a blade holder 134, but can alternatively be held by any other stabilizing structure or can be manufactured with blade holder 134 as a unitary component. Fold blade 104 can be fixed or can alternatively be movable (for example, along rails 128 in the y-axis of FIG. 1A, or along any desired axis). Fold blade 104 can be made of metal (such as stainless steel) or any other formable material, and can be shaped as a flat strip or can include a rounded shape, these example being non-limiting, of course.

Figure 2:
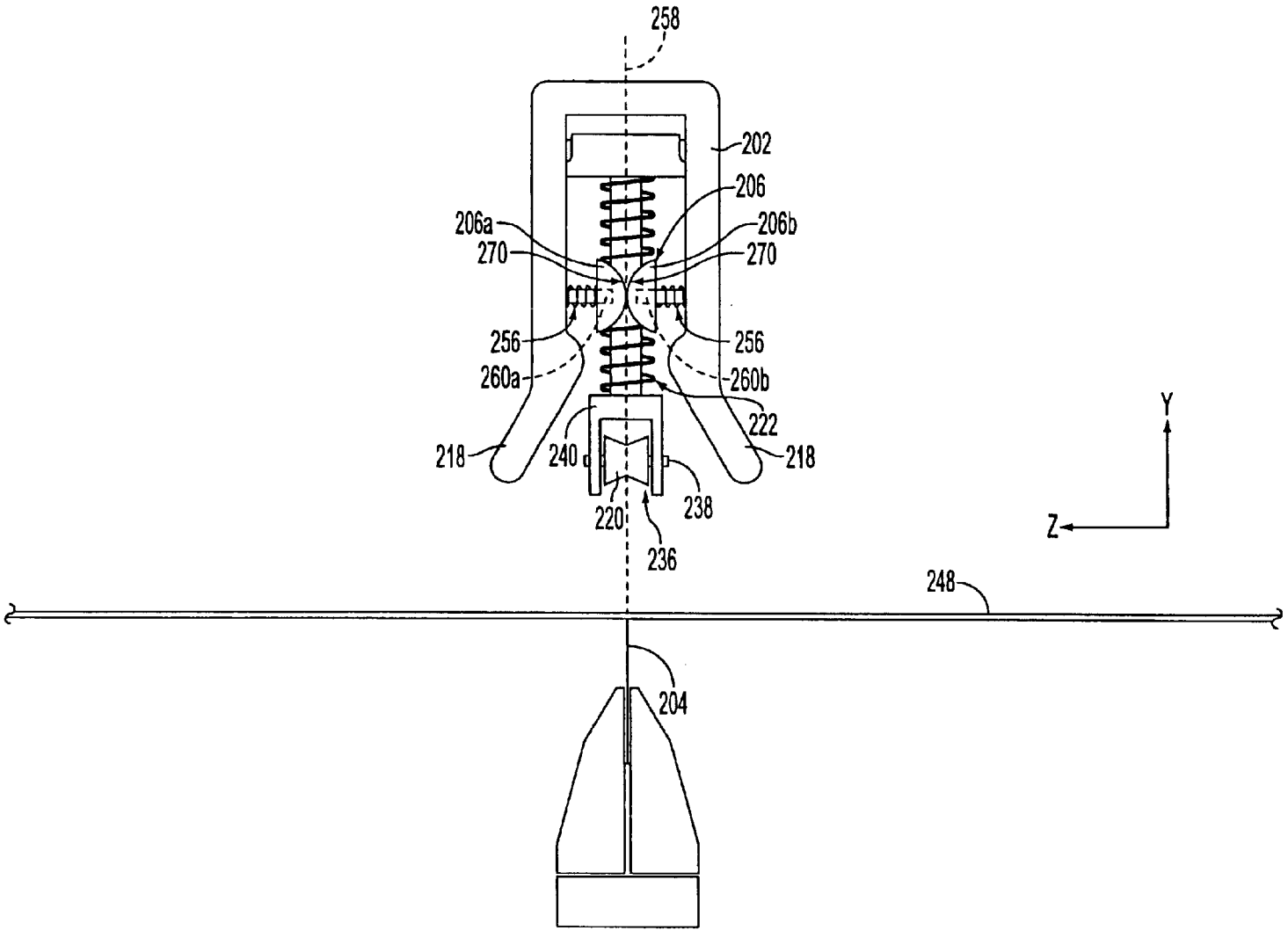
FIG. 2 illustrates a frontal view of components of a folding apparatus in accordance with the embodiment shown in FIGS. 1A and 1B.

Folding apparatus 100 also includes two fold components biased toward one another, such as fold rollers 106*a* and 106*b*. In the embodiment shown in FIGS. 1A and 1B, fold rollers 106*a* and 106*b* operate together to form a grooved fold roller 106 and fold groove 150. Folding apparatus 100 can include any number of rollers 106 (and therefore any number of fold rollers 106*a* and 106*b*). Rollers 106*a* and 106*b* rotate about an axis perpendicular to a longitudinal axis of fold blade 104 and, in the FIG. 1A example, this axis of rotation is along the z-axis and the longitudinal axis of fold blade 104 is along the x-axis. Rollers 106*a* and 106*b* can be made of metal or any other formable material, and can be coated with an elastomeric or deformable material such as an elastomer. Rollers 106*a* and 106*b* can be circular in cross-section (as shown in FIGS. 1A and 1B), or can alternatively have any other cross-sectional shape that can operate with fold blade 104 to create a fold in sheet material. A frontal view of housing 102 and rollers 106*a* and 106*b* is shown in FIG. 2, where these elements are represented by housing 202 and rollers 206*a* and 206*b*.

A first drive means is provided for moving at least one of the fold blade and the two fold rollers to position the fold blade between the two fold rollers and thereby displace the two rollers away from one another, where the two fold components are mounted on different support elements. In the exemplary embodiment shown in FIGS. 1A and 1B, the first drive means is represented by first drive assembly 112, which includes a lead screw (represented by one of lead screws 128), where a rotation of the lead screw in a first direction is operable to move the fold roller against the fold blade to create a fold in a sheet material. First drive assembly 112 also includes first motor 114 and belts 132*a–b*. First motor 114 can be of any conventional type (such as electric, pneumatic, or hydraulic), or can be of any other type. The exemplary lead screws 128 can be rotated by first motor 114 via drive belts 132*a–b* or alternatively by any other power transmitting element, such as a chain. Also, first drive assembly 112 can alternatively be formed as any other actuating system, such as, but not limited to, four-bar linkages, slider-crank mechanisms, pulleys and belts, rack and pinions, and linear actuators (e.g., soleniods, linear electric motors, and hydraulic or pneumatic cylinders).

As first motor 114 is driven by a power supply and controlled by, for example, a controller, lead screws 128 rotate and cause brackets 130 to move along the y-axis, the direction of their movement dependent on the direction of rotation of the lead screws 128. Housing 102 is connected to brackets 130*a* and 130*b* by rods 126 and thereby translates along the y-axis when first motor 114 is driven. Housing 102 has a longitudinal axis in the x-axis and can be made of any formable material, such as, but not limited to, metal or plastic.

Also provided in the exemplary folding apparatus 100 is a second drive means (such as second drive assembly 108) for moving the two fold components along a longitudinal axis of the fold blade. Second drive assembly 108 includes second motor 110 (mounted on bracket 130*a*), gear assembly 154, and lead screw 144. Second motor 110 can, of course, be alternatively mounted on bracket 130*b* or on another component. As with first motor 114, second motor 110 can be of any conventional type (such as electric, pneumatic, or hydraulic), or can be of any other type. The exemplary lead screw 144 can be rotated by second motor 110 via gear assembly 154 or alternatively by any other power transmitting element, such as a chain. Also, second drive assembly 108 can alternatively be formed as any other actuating system, such as, but not limited to, four-bar linkages, slider-crank mechanisms, pulleys and belts, rack and pinions, and linear actuators (e.g., soleniods, linear electric motors, and hydraulic or pneumatic cylinders). As second motor 110 is driven by a power supply and controlled by, for example, a controller, lead screw 144 rotates and causes housing 102 to move along rods 126 in the x-axis, with the direction of its movement (i.e., in the +x or −x direction) dependent on the direction of rotation of lead screw 144. As fold rollers 106*a* and 106*b* are rotatably mounted to housing 102 by roller axles 142, operation of second motor 110 moves fold rollers 106*a* and 106*b* along the longitudinal axis (i.e., the x-axis) of fold blade 104.

Figure 3:
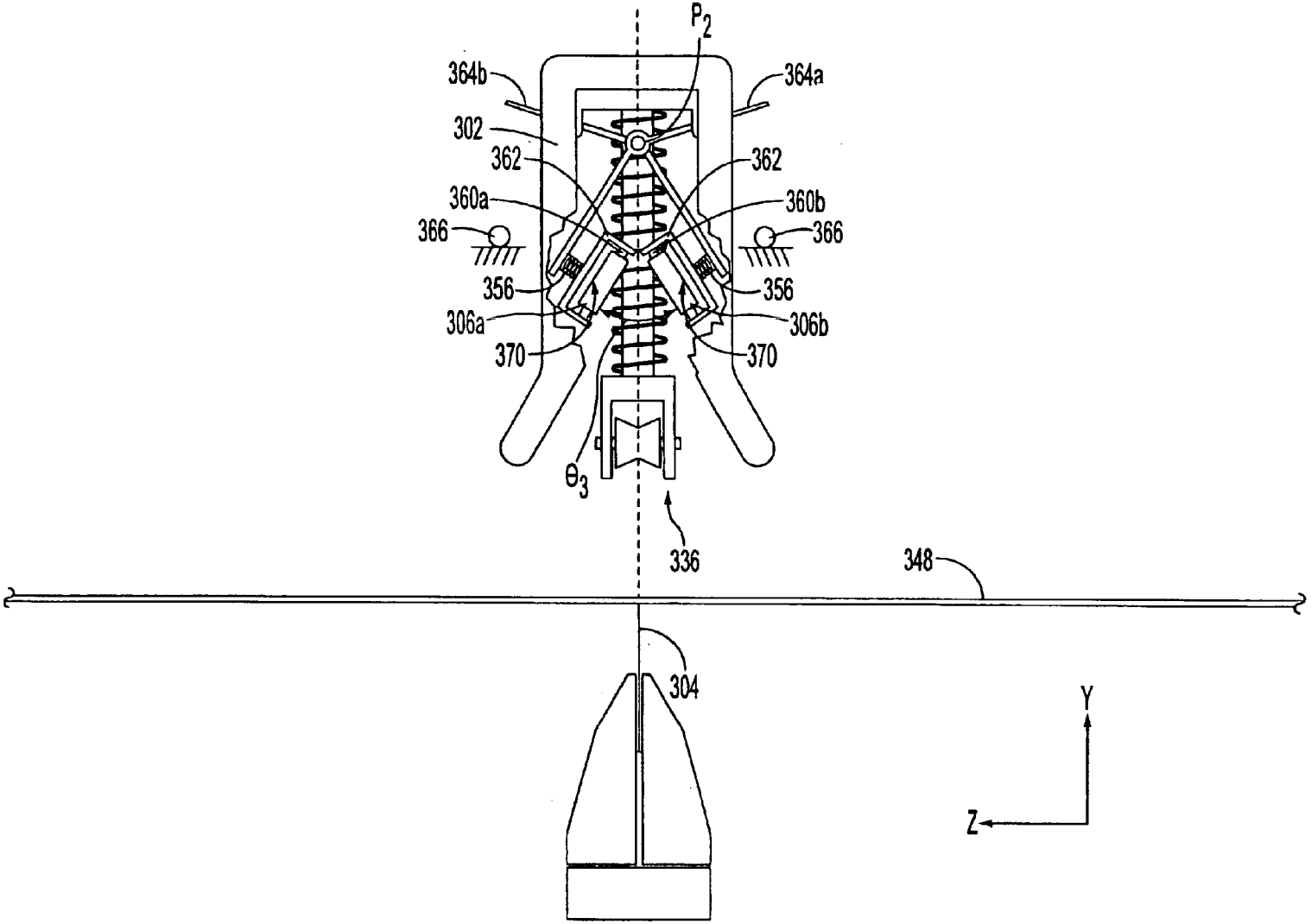
FIG. 3 illustrates a cutaway frontal view of components of a folding apparatus in accordance with a second exemplary embodiment of the present invention.
Figure 4:
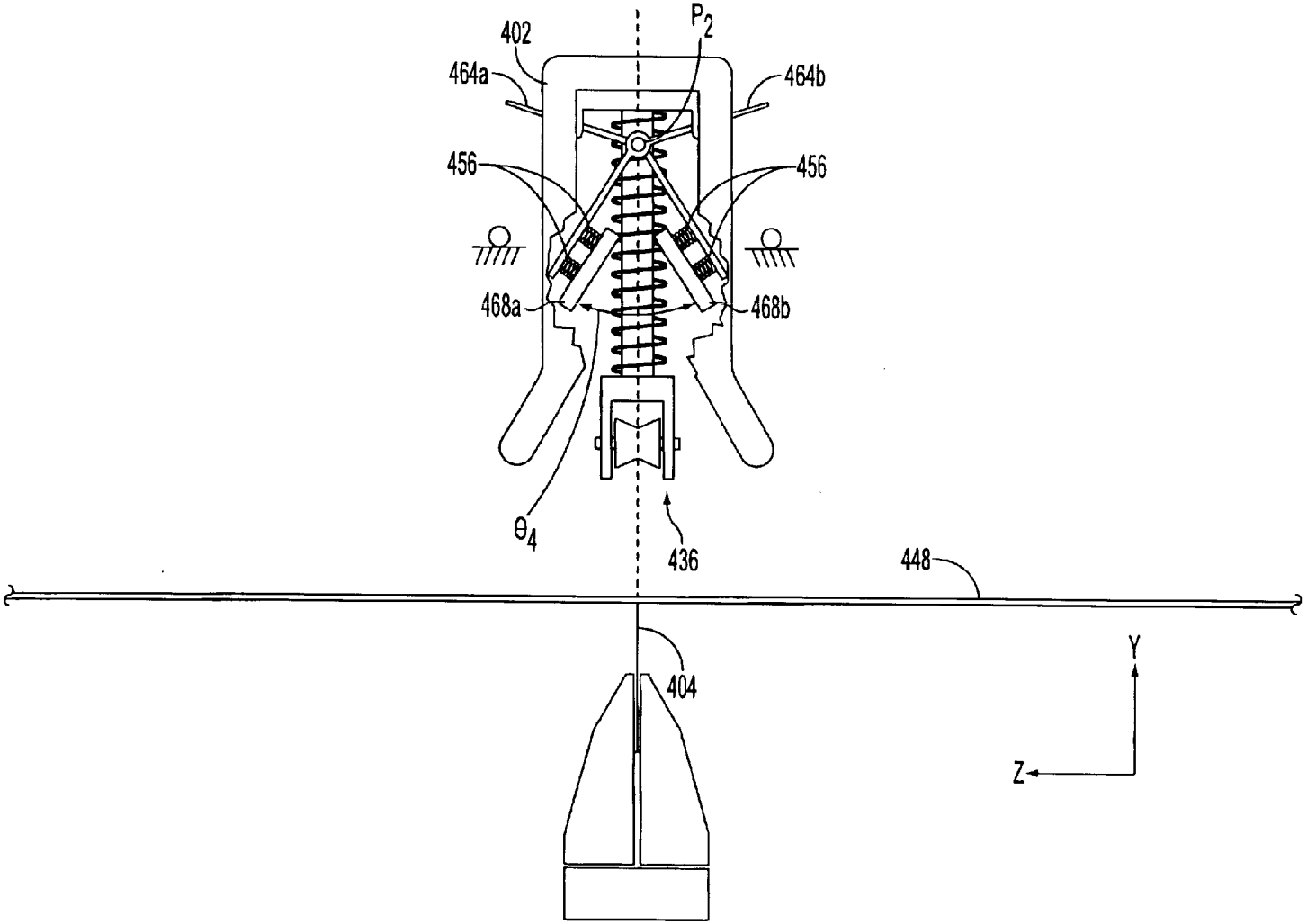
FIG. 4 illustrates a cutaway frontal view of components of a folding apparatus in accordance with a third exemplary embodiment of the present invention.

In the exemplary folding apparatus 100, the two fold components are biased toward one another by springs positioned on the support elements. FIGS. 2–4 each illustrate a different type of fold component that can be used in folding apparatus 100. For example, in the FIG. 2 embodiment, fold rollers 206*a* and 206*b* are biased toward one another by springs 256 positioned on roller axles 206*a* and 206*b*, which are in turn mounted to housing 202. In the FIG. 3 embodiment, fold rollers 306*a* and 306*b* are biased toward one another by springs 356 positioned between brackets 362 and levers 364*a* and 364*b*. In the FIG. 4 embodiment, fold plates 468*a* and 468*b* are biased toward one another by springs 456 positioned between fold plates 468*a* and 468*b* and levers 464*a* and 464*b*, respectively. Springs 256, 356, and 456 can be of the quantity shown in their associated figures, or can alternatively be of any number. Also, the spring rates of springs 256, 356, and 456 can be within any range that allows both the accommodation of various sheet material between the associated fold rollers and the precise folding of sheet material. Additionally, springs 256, 356, and 456 can be in the form of coil springs (as shown in the associated figures) or can alternatively be formed as any other biasing means (e.g., a component including an elastic material such as rubber).

In the embodiments shown in FIGS. 2 and 3, the two fold components are first and second fold rollers (such as fold rollers 206*a* and 206*b*), and the support elements are first and second roller axles (such as roller axles 260*a* and 260*b*), where the first fold roller is rotatably mounted on the first roller axle, and the second fold roller is rotatably mounted on the second roller axle. In the FIG. 2 embodiment, the first and second roller axles are longitudinally aligned in a first axis, and the first axis is perpendicular to the longitudinal axis of the fold blade. For example, roller axles 260*a* and 260*b* are arranged as separate components, but are aligned along the z-axis such that rotation of fold rollers 206*a* and 206*b* is concentric. Alternatively, fold rollers 206*a* and 206*b* can be rotatably mounted on a common roller axle. Also, each of first and second fold rollers 206*a* and 206*b* operate as one half of a grooved fold roller 206, where each of the first and second fold rollers 206*a* and 206*b* has a folding profile 270 that is substantially hemispherical in shape. Alternatively, each folding profile 270 can be conical (such that grooved fold roller 206 assumes a v-shape in an initial or undisplaced state) or can be any other shape that can produce a fold in a sheet in conjunction with fold blade 104.

In the FIG. 3 embodiment, first and second roller axles (such as roller axles 360*a* and 360*b*) are oriented in different axes, and operation of the first drive means changes an orientation of the first and second roller axles. For example, in the FIG. 3 example, fold rollers 306*a* and 306*b* are rotatably mounted on roller axles 360*a* and 360*b*, respectively, which are in turn mounted to levers 364*a* and 364*b* (via brackets 362 and springs 356). Each of the first and second fold rollers 306*a* and 306*b* has a folding profile 370 that is substantially cylindrical, but folding profile 370 can alternatively have any other shape that can form a fold in a sheet material in conjunction with fold blade 304. Fold rollers 306*a* and 306*b* can be made of metal or any other formable material, and can be coated with an elastomeric or deformable material such as an elastomer. Also, any number of fold rollers 306*a* and 306*b* can be arranged for use in folding apparatus 100.

Levers 364*a* and 364*b* are arranged to pivot about a pivot point $P_2$ when housing 302 is moved in the −y direction (by motor 114 in FIGS. 1A and 1B, for example) such that outer ends of levers 364*a* and 364*b* contact lever stops 366. Pivot point $P_2$ is fixedly positioned on housing 302 and can be formed as any conventional or other means, for example, with a roller bearing. Alternatively, fold rollers 306*a* and 306*b* can be arranged such that roller axles 360*a* and 360*b* are mounted onto housing 302 (via springs 356), rather than levers 364*a* and 364*b*. Also, fold rollers 306*a* and 306*b* can be alternatively moved (e.g., rotated) by a system other than the one illustrated (i.e., with levers 264*a* and 264*b*). For example, rotation of fold rollers 306*a* and 306*b* can be achieved using a separate motor and actuator, both of any conventional or other type.

In the FIG. 4 example, the two fold components are first and second fold plates (such as fold plates 468*a* and 468*b*), and the support elements are first and second levers (such as 464*a* and 464*b*). Fold plates 468*a* and 468*b* can be made of any material that can form a fold in a sheet material in conjunction with fold blade 404. For example, each fold plate 468*a* or 468*b* can be made of a polished metal or of a smooth polymer, these examples being non-limiting, of course. Fold plates 468*a* and 468*b* are elastically connected to levers 464*a* and 464*b*, respectively, by springs 456. Two springs 456 are shown to connect each fold plate 468*a* and 468*b*, but this number can be alternatively more or less. Alternatively, instead of being biased toward one another using springs 456, fold plates 468*a* and 468*b* can be deformed such that each of them provides a biasing force toward the other folding plate. For example, each fold plate 468*a* or 468*b* can be slightly bent toward the other plate such that a portion of the deformed fold plate will be displaced away from the other plate when fold blade 404 is positioned between the two fold plates 468*a* and 468*b*. Also, alternatively, each fold plate 468*a* or 468*b* can be made of a material that is naturally deformable, can provide a biasing force towards the other fold plate, and can also form a fold in sheet material 448 in conjunction with fold blade 404.

As with fold rollers 368*a* and 368*b* described above, fold plates 468*a* and 468*b* can be moved as a result of movement of housing 402 (i.e., through rotation of levers 464*a* and 464*b* about pivot point $P_2$). Alternatively, fold rollers 468*a* and 468*b* can be moved by any other means, or can be attached to housing 402 via springs 456. Also, any number of fold rollers 468*a* and 468*b* can be arranged for use in folding apparatus 100.

As shown in FIGS. 1A and 1B, housing 102 includes at least one pinch wheel, such as one of pinch wheels 120, for clamping sheet material against the fold blade, wherein the at least one pinch foot is elastically mounted to the housing. Each pinch wheel 120 is part of a pinch assembly 136, which includes a pinch bracket 140, a pinch axle 138, a pinch shaft 116, and a pinch spring 122. Exemplary pinch assemblies are shown in FIGS. 2–4 as pinch assemblies 236, 336, and 436, respectively. Each pinch wheel is rotatably attached to a pinch bracket 140 via a pinch axle 138, and each pinch bracket is attached to housing 102 via a pinch shaft 116 and pinch spring 122. Pinch shafts 116 permit vertical translation of pinch assemblies 136 during a folding operation. The FIG. 1B example shows four pinch assemblies 136, although this number can alternatively be greater or lesser.

Pinch wheels 120 are rotatable about pinch axles 138 and can be made of any formable material (metal and plastic being non-limiting examples) or of a deformable or elastomeric material. In the embodiment shown in FIGS. 1A and 1B, each pinch wheel 102 has a concave cylindrical contact surface, but this surface can also be a different shape (e.g., convex or flat). Pinch springs 122 can be linear, coil springs or can alternatively be any other elastic attaching means. Pinch wheels 120 are vertically biased by pinch springs 122 such that housing 102 can continue to translate towards fold blade 104 after pinch wheels 232 have engaged a sheet against fold blade 104, thereby anchoring it in place during a fold operation. Also, pinch assemblies 136 can alternatively include pinching components that are not rotatable and are not formed as wheels. For example, the clamping operation of pinch wheels 120 can instead be performed by a non-rotatable pinch foot with a v-shaped groove.

Housing 102 also includes fold flaps, such as two fold flaps 118, for forcing a sheet material around the fold blade. Fold flaps 118 can be arranged to have any angle between them such that blade holder 134 fits between fold flaps 118 during a folding operation. Fold flaps 118 can be manufactured with housing 102 as a unitary component or separately from housing 102, and can be manufactured from the same material as housing 102 or from a different, formable material. Fold flaps 118 can be fixedly positioned, or can alternatively be pivotally attached to each other. Fold flaps can also be pivotably biased towards each other by using, for example, flap springs 124. This arrangement allows the adjusting of the angle between fold flaps 118 to accommodate different sheet material thickness. Alternatively, any other elastic connecting means can be used to bias the fold flaps 118 towards one another.

The folding operation of folding apparatus 100 includes a step of feeding a sheet material into an area between two fold components (such as fold rollers 206*a*–*b* or 306*a*–*b*, or such as fold plates 406*a*–*b*, for example) and a fold blade (such as one of fold blades 204, 304, and 404), where the two fold components are biased toward one another and are mounted on different support elements. For example, in the FIG. 2 embodiment, sheet material 248 is advanced a predetermined distance in the +z or −z direction such that sheet material 248 is positioned between fold rollers 206*a*–*b* and fold blade 204. FIGS. 1A and 1B illustrate a sheet path SP of sheet material 248 in the −z direction, for example. The predetermined distance can be chosen by the desired width of the booklet and, for example, the location of the sheet in the booklet, as described in the Trovinger PCT. Sheet material 248 is positioned across fold blade 204 such that the location where a fold is desired is placed directly over the fold blade 204.

Once sheet material 248 is positioned over the fold blade 204, housing 202 translates towards sheet material 248 and fold blade 204 in the −y direction through operation of first drive assembly 112 (FIGS. 1A and 1B). Pinch wheel 220 captures sheet material 248 against fold blade 204 by the force created by pinch springs 222 and, as housing 202 continues its advancement, pinch wheel 220 continues to maintain a securing force against sheet material 248 and fold blade 204 through the biasing action of the compressed pinch spring 222. A slack loop can be form in sheet material 248 by, for example, a paper drive assembly, as described in the Trovinger PCT.

The folding operation also includes a step of moving the two fold components and the fold blade relative to one another to form a fold in the sheet using the fold blade, thereby displacing the two components away from one another. During this step, a first drive means (such as first drive means 112) moves at least one of the fold blade and the two fold components to position the fold blade between the two fold components. For example, housing 202 continues its advancement toward fold blade 204, and as fold rollers 206*a* and 206*b* engage sheet material 248 and deform it over fold blade 204, they are displaced away from each other while maintaining a biased force against sheet material 248. In this way, fold rollers 206*a* and 206*b* can self-adjust to accommodate sheet material of any construction and thickness. Similarly, in the FIG. 3 embodiment, fold rollers 306*a* and 306*b* are positioned (e.g., by levers 364*a* and 364*b*) to engage sheet material 348 and deform it over fold blade 304. In the FIG. 4 embodiment, fold plates 406*a* and 406*b* are positioned (e.g., by levers 464*a* and 464*b*) to engage sheet material 448 and deform it over fold blade 404.

Also during the above step, a second drive means (such as second drive means 108) moves the two fold components along a longitudinal axis of the fold blade. For example, after fold rollers 206*a* and 206*b* have been fully advanced around fold blade 204, housing 202 is moved transversely back and forth along the fold blade 204 by second drive assembly 108 to fully crease the sheet all along the length of the fold. This sub-step can be similarly performed with fold rollers 306*a* and 306*b*, and with fold plates 406*a* and 406*b*. Fold rollers 106 (which can represent any of fold rollers 206, 306, and 406) are spaced apart and travel a horizontal distance sufficient to insure that every point along the edge of a fold is contacted and creased by at least one fold roller 106.

The above process can be repeated to fully crease sheet material 248 along the length of a fold. Once a fold is fully formed in sheet material 248, housing 202 is translated away from fold blade 204 to an initial position and, in so doing, pinch wheel 220 releases folded sheet material 248 from fold blade 204. Folded sheet material can then be ejected from folding apparatus 100 and delivered to a downstream device, such as a sheet-collecting saddle, for example.

Exemplary embodiments of the present invention can be modified to include features from any or all of the following copending applications, all filed on even date herewith, the disclosures of which are hereby incorporated by reference in their entirety: Sheet Folding Apparatus With Pivot Arm Fold Rollers, Ser. No. 09/970,877; Sheet Folding Apparatus, Ser. No. 09/970,730; Thick Media Folding Method, Ser. No. 09/970,748; and Sheet Folding Apparatus With Rounded Fold Blade, Ser. No. 09/970,840.

The exemplary embodiments of the present invention provide for the folding of a wide range of sheet material thicknesses and types. It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A system for folding sheet material, comprising:

a fold blade;

two fold components biased toward one another and contacting at a contact point;

first drive means for moving at least one of the fold blade and the two fold components to position the fold blade between the contacting point of the two fold components and thereby displace the two components away from one another; and second drive means for moving the two fold components along a longitudinal axis of the fold blade, wherein the two fold components are mounted on different support elements and wherein the two fold components maintain pressure contact with the fold blade when the second drive means moves the two fold components along the longitudinal axis of the fold blade.

2. The system of claim 1, wherein the two fold components are biased toward one another by springs positioned on the support elements.

3. The system of claim 1, wherein the two fold components are first and second fold rollers, and the support elements are first and second roller axles.

4. The system of claim 3, wherein the first fold roller is rotatably mounted on the first roller axle, and the second fold roller is rotatably mounted on the second roller axle.

5. The system of claim 4, wherein the first and second roller axles are longitudinally aligned in a first axis, and the first axis is perpendicular to the longitudinal axis of the fold blade.

6. The system of claim 5, wherein each of the first and second fold rollers operate as one half of a grooved fold roller.

7. The system of claim 6, wherein each of the first and second fold rollers has a folding profile that is substantially hemispherical.

8. The system of claim 4, wherein the first and second roller axles are oriented in different axes, and operation of the first drive means changes an orientation of the first and second roller axles.

9. The system of claim 8, wherein each of the first and second fold rollers has a folding profile that is substantially cylindrical.

10. The system of claim 1, wherein the two fold components are first and second fold plates, and the support elements are first and second levers.

11. The system of claim 10, wherein each of the first and second fold plates is deformed such that it provides a biasing force toward the other fold plate.

12. A method for folding a sheet of material, comprising the steps of:

feeding a sheet material into an area between two fold components and a fold blade, wherein the two fold components are biased toward one another and are mounted on different support elements and contact at a contacting point; and moving the two fold components and the fold blade relative to one another to form a fold in the sheet using the fold blade, thereby displacing the two components away from one another, wherein a first drive means moves at least one of the fold blade and the two fold components to position the fold blade between the contacting point of the two fold components, and wherein a second drive means moves the two fold components along a longitudinal axis of the fold blade to form a fold in the sheet of material.

13. The method of claim 12, wherein the two fold components are first and second fold rollers, and the support elements are first and second roller axles.

14. The method of claim 12, wherein the two fold components are first and second fold plates, and the support elements are first and second levers.

* * * * *